US011739608B2

(12) United States Patent
Hallundbæk

(10) Patent No.: US 11,739,608 B2
(45) Date of Patent: Aug. 29, 2023

(54) DOWNHOLE COMPLETION SYSTEM

(71) Applicant: WELLTEC OILFIELD SOLUTIONS AG, Zug (CH)

(72) Inventor: Jørgen Hallundbæk, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 17/554,633

(22) Filed: Dec. 17, 2021

(65) Prior Publication Data

US 2022/0195832 A1 Jun. 23, 2022

(30) Foreign Application Priority Data

Dec. 18, 2020 (EP) ..... 20215501

(51) Int. Cl.
*E21B 33/124* (2006.01)
*E21B 33/127* (2006.01)

(52) U.S. Cl.
CPC ..... *E21B 33/1243* (2013.01); *E21B 33/124* (2013.01); *E21B 33/127* (2013.01)

(58) Field of Classification Search
CPC ... E21B 33/124; E21B 33/1243; E21B 33/127
See application file for complete search history.

(56) References Cited

U.S. PATENT DOCUMENTS

2014/0196887 A1 7/2014 Hallundbæk
2016/0053568 A1* 2/2016 Saltel ..... E21B 33/126 166/179
2016/0298414 A1* 10/2016 Stæhr ..... E21B 23/06
2017/0145777 A1* 5/2017 Vasques ..... E21B 33/127
2019/0242212 A1* 8/2019 Kræmer ..... E21B 33/127
2020/0040693 A1* 2/2020 Vasques ..... E21B 33/128
2022/0090455 A1* 3/2022 Roselier ..... E21B 33/128

FOREIGN PATENT DOCUMENTS

EP 2 963 236 1/2016
EP 3 159 478 4/2017
EP 3 521 551 8/2019

OTHER PUBLICATIONS

Extended European Search Report for EP20215501 dated May 14, 2021, 7 pages.

* cited by examiner

*Primary Examiner* — Yong-Suk (Philip) Ro
(74) *Attorney, Agent, or Firm* — Nixon & Vanderhye P.C.

(57) ABSTRACT

A downhole completion system includes a well tubular metal structure having an inner face, and a first, second and third annular barriers, each annular barrier having a tubular metal part mounted as part of the well tubular metal structure, an expandable metal sleeve surrounding the tubular metal part, each end section of the expandable metal sleeve being connected with the tubular metal part, an annular barrier space between the tubular metal part and the expandable metal sleeve, and an expansion opening in the tubular metal part and a fluid channel fluidly connecting the expansion opening and the annular barrier space through which pressurised fluid passes for expanding the expandable metal sleeve and bringing the annular barrier from an unexpanded position to an expanded position. The second annular barrier is arranged in between the first annular barrier and the third annular barrier, and the second annular barrier is configured to expand at a lower pressure than the first and third annular barriers.

19 Claims, 6 Drawing Sheets

DOWNHOLE COMPLETION SYSTEM

Figure 1A:
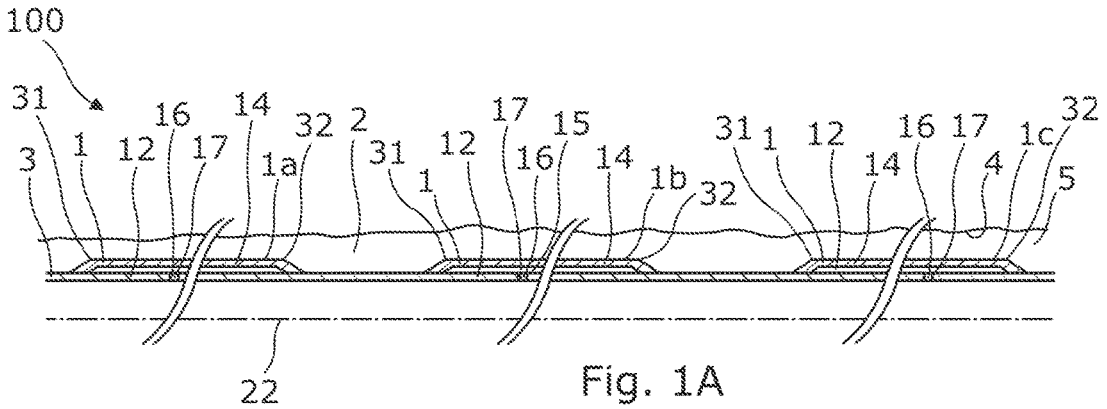

This application claims priority to EP Patent Application No. 20215501.6 filed Dec. 18, 2020, the entire contents of which are hereby incorporated by reference.

The present invention relates to a downhole completion system for isolating several zones in a well having a top. The invention also relates to a downhole completion method for completing a downhole completion system.

Annular barriers are used downhole to provide isolation of one zone from another in an annulus in a borehole of a well between a well tubular metal structure and the borehole wall or another well tubular metal structure. When expanding annular barriers, it is important that the annular barriers are expanded to abut the inner face of the borehole or other well tubular metal structure to provide proper zonal isolation.

It is an object of the present invention to wholly or partly overcome the above disadvantages and drawbacks of the prior art. More specifically, it is an object to provide an improved downhole completion system ensuring that all annular barriers are expanded to abut the inner face of the borehole or other well tubular metal structure to provide proper zonal isolation.

The above objects, together with numerous other objects, advantages and features, which will become evident from the below description, are accomplished by a solution in accordance with the present invention by a downhole completion system for isolating several zones in a well having a top, comprising:

- a well tubular metal structure arranged in a borehole having an inner face in the well, and
- a first annular barrier, a second annular barrier and a third annular barrier, each annular barrier comprising:
  - a tubular metal part, the tubular metal part being mounted as part of the well tubular metal structure,
  - an expandable metal sleeve surrounding the tubular metal part, each end section of the expandable metal sleeve being connected with the tubular metal part,
  - an annular barrier space between the tubular metal part and the expandable metal sleeve, and
  - an expansion opening in the tubular metal part and a fluid channel fluidly connecting the expansion opening and the annular barrier space through which pressurised fluid passes for expanding the expandable metal sleeve and bringing the annular barrier from an unexpanded position to an expanded position, wherein the second annular barrier is arranged in between the first annular barrier and the third annular barrier, and the second annular barrier is configured to expand at a lower pressure than the first and third annular barriers.

Additionally, the above objects, together with numerous other objects, advantages and features, which will become evident from the below description, are accomplished by a solution in accordance with the present invention by a downhole completion system for isolating several zones in a well having a top, comprising:

- a well tubular metal structure arranged in a borehole having an inner face in the well, and
- a first annular barrier, a second annular barrier and a third annular barrier, each annular barrier comprising:
  - a tubular metal part, the tubular metal part being mounted as part of the well tubular metal structure,
  - an expandable metal sleeve surrounding the tubular metal part, each end section of the expandable metal sleeve being connected with the tubular metal part,

- an annular barrier space between the tubular metal part and the expandable metal sleeve, and
  - an expansion opening in the tubular metal part and a fluid channel fluidly connecting the expansion opening and the annular barrier space through which pressurised fluid passes for expanding the expandable metal sleeve and bringing the annular barrier from an unexpanded position to an expanded position, wherein the second annular barrier is arranged in between the first annular barrier and the third annular barrier, and the second annular barrier is arranged in between the first annular barrier and the third annular barrier, and the second annular barrier expands at a first pressure, the first annular barrier expands at a second pressure, the third annular barrier expands at a third pressure, the first pressure barrier is lower than the second pressure and/or third pressure.

In addition, the second annular barrier may expand prior to expansion of the first and third annular barriers in that:

- the expandable metal sleeve of the second annular barrier expands at a lower pressure than the expandable metal sleeve of the first and third annular barriers,
- the expandable metal sleeve of the second annular barrier has a first thickness being smaller than a second thickness of the expandable metal sleeve of the first and third annular barriers,
- the expandable metal sleeve of the second annular barrier is made of a metal material being more ductile than the metal material of the expandable metal sleeve of the first and third annular barriers,
- the expandable metal sleeve of the second annular barrier is more flexible than the expandable metal sleeve of the first and third annular barriers,
- the expandable metal sleeve of the first and third annular barriers has several sections having a greater thickness than other sections of the expandable metal sleeve of the first and third annular barriers, and the expandable metal sleeve of the second annular barrier has fewer sections having a greater thickness than other sections of the expandable metal sleeve of the second annular barrier,
- the first and third annular barriers are provided with a shear disc in the fluid channel between the expansion opening and the annular barrier space,
- the second annular barrier comprises a pressure intensifier configured to increase the pressure entering the expansion opening before entering the annular barrier space,
- the first and third annular barriers comprise a pressure relief valve in the fluid channel,
- the first and third annular barriers comprise a sequence valve which is activated to open for fluid communication to the annular barrier spaces of the first and third annular barriers at a predetermined pressure in the annular barrier space of the second annular barrier, or
- the first and third annular barriers each comprise a throttle valve in the fluid channel.

Furthermore, the second pressure may be equal to or the same as the third pressure.

When expanding three or more annular barriers simultaneously against an inner face of an impermeable part of the borehole formation or against another well tubular metal structure, there is a risk that the middle annular barrier cannot be fully expanded. If the well tubular metal structure comprises three annular barriers, and there is a risk that the second middle annular barrier between the first annular barrier and the third annular barrier will be unable to fully expand if the expandable metal sleeve of the first and third annular barriers abut the inner face first, then the first and third annular barriers will enclose a volume of liquid, and the expandable metal sleeve of the second middle annular barrier will not be able to fully expand since the liquid in the volume cannot be displaced through the impermeable formation or the other well tubular metal structure. By having the second annular barrier arranged in between the first annular barrier and the third annular barrier and by it being configured to expand at a lower pressure than the first and third annular barriers, it is ensured that all three annular barriers are able to fully expand. This is of special importance if the first and second annular barriers isolate a production zone, and the second and third annular barriers isolate a water-producing zone. Also when the three annular barriers are to carry a certain load when used for hanging off a liner, it is important that all the annular barriers are carrying the intended load, and in such situation, the expandable metal sleeves of the annular barriers are expanded to abut the inner face of another well tubular metal structure.

Moreover, the expandable metal sleeve of the second annular barrier may expand at a lower pressure than the expandable metal sleeve of the first and third annular barriers.

Furthermore, the expandable metal sleeve of the second annular barrier may have a first thickness being smaller than a second thickness of the expandable metal sleeve of the first and third annular barriers.

In addition, the expandable metal sleeve of the second annular barrier may be made of a metal material being more ductile than the metal material of the expandable metal sleeve of the first and third annular barriers.

Also, the expandable metal sleeve of the second annular barrier may be more flexible than the expandable metal sleeve of the first and third annular barriers.

Further, the expandable metal sleeve of the second annular barrier may be made of a metal material being more flexible than the metal material of the expandable metal sleeve of the first and third annular barriers.

Moreover, the second annular barrier may comprise means for expanding the second annular barrier before the first and third annular barriers.

Furthermore, the means may be that the expandable metal sleeve of the second annular barrier has a first thickness being smaller than a second thickness of the expandable metal sleeve of the first and third annular barriers.

In addition, the means may be that the expandable metal sleeve of the second annular barrier is made of a metal material being more ductile than the metal material of the expandable metal sleeve of the first and third annular barriers.

Also, the means may be that the expandable metal sleeve of the second annular barrier is made of a metal material being more flexible than the metal material of the expandable metal sleeve of the first and third annular barriers.

Further, the downhole completion system may comprise a fourth annular barrier arranged next to the first annular barrier closer to the top and a fifth annular barrier next to the third annular barrier furthest away from the top, the second thickness of the expandable metal sleeve of the first and third annular barriers being smaller than a third thickness of the expandable metal sleeve of the fourth and fifth annular barriers.

Moreover, the expandable metal sleeve of the first and third annular barriers may have several sections having a greater thickness than other sections of the expandable metal sleeve of the first and third annular barriers, and the expandable metal sleeve of the second annular barrier may have fewer sections having a greater thickness than other sections of the expandable metal sleeve of the second annular barrier.

Furthermore, the expandable metal sleeve of the first and third annular barriers may have several sections having a greater thickness than other sections of the expandable metal sleeve of the first and third annular barriers, and the expandable metal sleeve of the second annular barrier may not have any sections having a greater thickness than other sections of the expandable metal sleeve of the second annular barrier.

In addition, the first and third annular barriers may be provided with a dissolvable disc in the fluid channel between the expansion opening and the annular barrier space.

Also, the first and third annular barriers may be provided with a dissolvable disc in the fluid channel between the expansion opening and the annular barrier space, and the second annular barrier may have no dissolvable disc in the fluid channel between the expansion opening and the annular barrier space.

Further, the dissolvable disc may be designed so that the second annular barrier is fully expanded before the first and third annular barriers initiate expansion.

Moreover, the first and third annular barriers may be provided with a shear disc in the fluid channel between the expansion opening and the annular barrier space.

Furthermore, the second annular barrier may be fully expanded at a predetermined pressure, and the shear disc is sheared at a differential pressure matching the predetermined pressure so that the second annular barrier is fully expanded before the first and third annular barriers initiate expansion.

In addition, the first and third annular barriers may be provided with a shear disc in the fluid channel between the expansion opening and the annular barrier space, the second annular barrier having no shear disc in the fluid channel between the expansion opening and the annular barrier space.

Furthermore, the second annular barrier may be provided with a shear disc in the fluid channel between the expansion opening and the annular barrier space, the shear disc of the second annular barrier being designed to break at a lower pressure than that of the shear disc of the first and third annular barriers.

Also, the first and third annular barriers may be provided with a shear pin valve having a piston in a bore maintained in a first position by a shear pin which breaks at a predetermined pressure, shifting the piston to a second position in which fluid is allowed to flow from the expansion opening to the annular barrier space.

Further, the piston may have seals.

Moreover, the second annular barrier may comprise a pressure intensifier configured to increase the pressure entering the expansion opening before entering the annular barrier space.

Furthermore, the first and third annular barriers may have no pressure intensifier or a pressure intensifier which increases the pressure less than the pressure intensifier of the second annular barrier.

In addition, the second annular barrier may comprise a first pressure intensifier configured to increase the pressure entering the expansion opening before entering the annular barrier space, and the second annular barrier may comprise a second pressure intensifier configured to increase the pressure entering the expansion opening of the second annular barrier before entering the annular barrier space of the second annular barrier by 10-20 bars more than the first pressure intensifier.

Moreover, the first and third annular barriers may comprise a first pressure intensifier configured to increase the pressure entering the expansion opening before entering the annular barrier space, and the second annular barrier may comprise a second pressure intensifier configured to increase the pressure entering the expansion opening of the second annular barrier before entering the annular barrier space of the second annular barrier by 10-20 bars more than the first pressure intensifier.

Also, the first and third annular barriers may comprise a pressure relief valve in the fluid channel.

Further, the first and third annular barriers may comprise a sequence valve which is activated to open for fluid communication to the annular barrier spaces of the first and third annular barriers at a predetermined pressure in the annular barrier space of the second annular barrier.

Moreover, the first and third annular barriers may each comprise a throttle valve in the fluid channel.

Furthermore, the first and third annular barriers may each comprise a throttle valve in the fluid channel, and the second annular barrier may have no throttle valve in the fluid channel.

In addition, the first and third annular barriers may each comprise an activation unit for bringing a valve from a closed position to an open position when the pressure in the annular barrier space of the second annular barrier is above a predetermined pressure.

Also, the first and third annular barriers may each comprise an activation unit for bringing a valve from a closed position to an open position, the activation unit being activated by a pressure increase in the annular barrier space of the second annular barrier.

Further, each end section of the expandable metal sleeve of the second annular barrier may be connected to the tubular metal part by means of a connection part, each connection part being slidably connected to the tubular metal part.

Moreover, the first and third annular barriers may each comprise an orifice in the fluid channel, the fluid channel being fluidly connected to the annular barrier space upstream of the orifice so that a pressure increase upstream of the orifice activates a valve opening for fluid communication to the annular barrier space when the pressure increase is above a certain level.

Furthermore, the first and third annular barriers may each comprise an orifice in the fluid channel, the fluid channel being fluidly connected to the annular barrier space upstream of the orifice, the inner diameter of the fluid channel of the second annular barrier being larger than the inner diameter of the orifice.

In addition, when the inner diameter of the fluid channel of the second annular barrier is larger than the inner diameter of the orifice, the second annular barrier may be expanded at a lower flow rate than the first and third annular barriers.

Also, the well tubular metal structure may be connected with the drill pipe or coiled tubing closer to the top of the well than the first annular barrier.

Further, the well tubular metal structure may have a first end closest to the top and a second end, the downhole completion system further comprising a drill pipe or coiled tubing connected at a first end with the well tubular metal structure at the first end of the well tubular metal structure.

Moreover, the annular barrier space of the second annular barrier may comprise a compound such as a swellable material increasing the expansion rate of the second annular barrier compared to that of the first and third annular barriers.

The invention also relates to a downhole completion method for completing a downhole completion system according to any of the preceding claims, comprising:

mounting tubular sections with tubular metal parts of the well tubular metal structure having the first, second and third annular barriers, the second annular barrier being mounted to be arranged in between the first annular barrier and the third annular barrier, lowering the well tubular metal structure in the well until the well tubular metal structure is arranged in a predetermined position, and pressurising the well tubular metal structure to a first pressure and expanding the second annular barrier.

Moreover, during the pressurising of the well tubular metal structure to a first pressure and expansion of the second annular barrier, the first and third annular barriers may remain unexpanded.

Furthermore, the expansion of the first and third annular barriers may be initiated after the expansion of the second annular barrier has been initiated.

In addition, the completion method may comprise increasing the pressure to a second pressure to also expand the first and third annular barriers.

Further, before lowering the well tubular metal structure, the downhole completion method may comprise connecting a drill pipe to a first end of the well tubular metal structure, and lowering the well tubular metal structure may also comprise lowering the drill pipe into the borehole until the well tubular metal structure is arranged in a predetermined position, the pressurising of the well tubular metal structure also comprising pressurising the drill pipe.

Finally, the pressurising of the well tubular metal structure to a first pressure may be performed at a predetermined first flow rate, the downhole completion method further comprising increasing the flow rate to a second flow rate to also expand the first and third annular barriers.

Figure 1B:
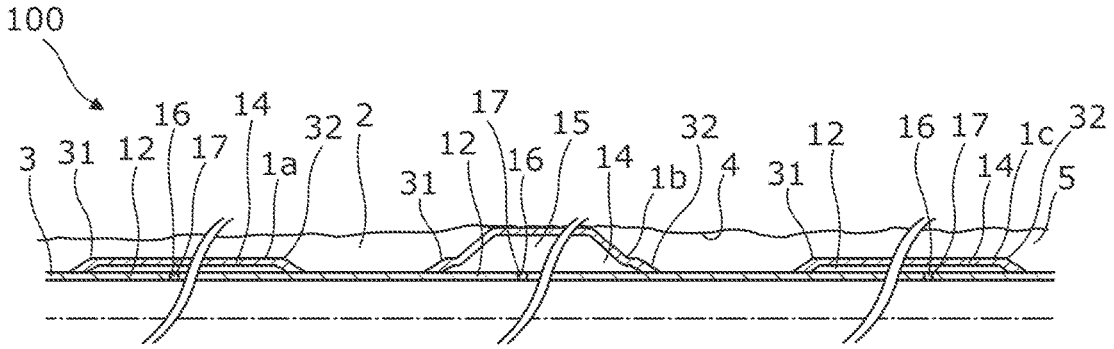
Figure 1C:
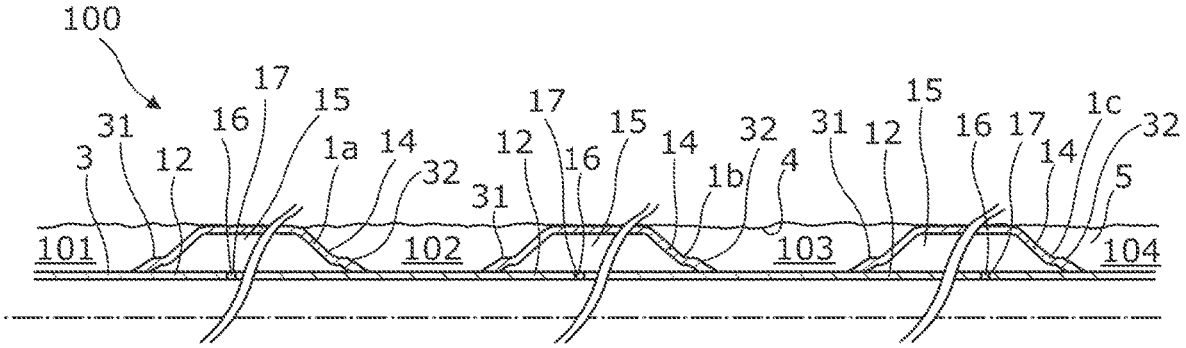
Figure 2:
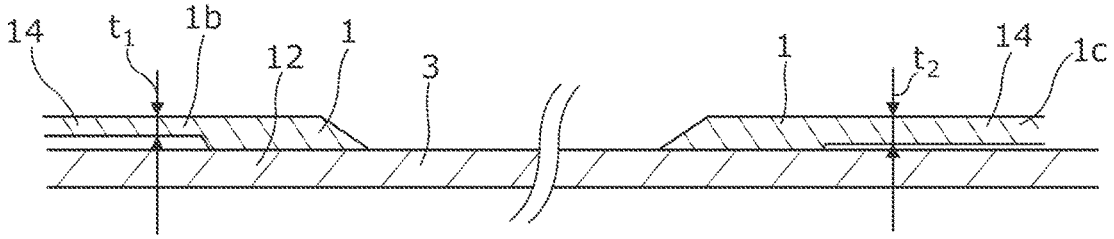
Figure 3:
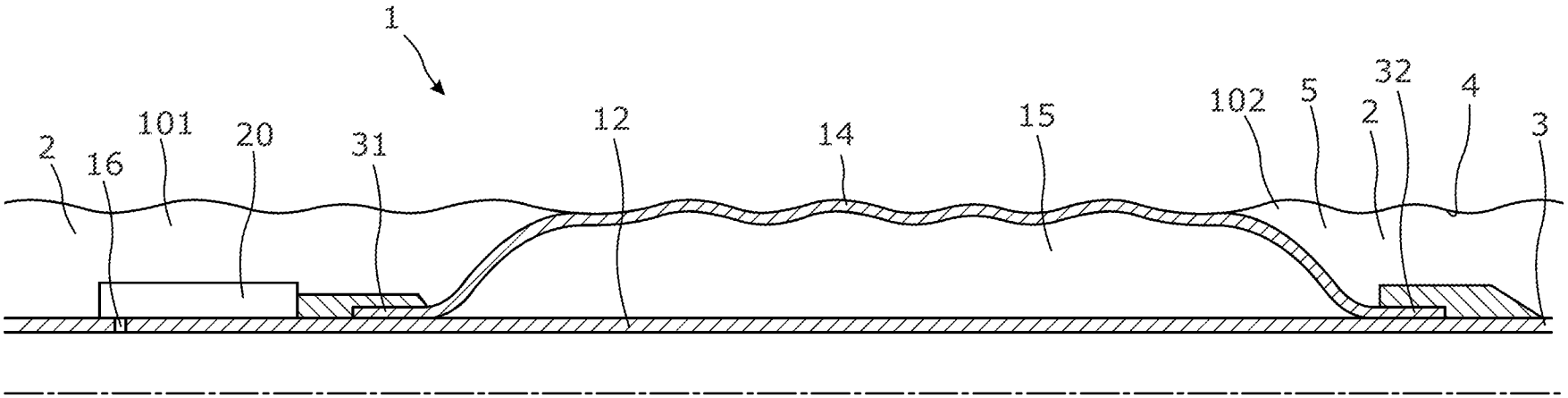
Figure 4:
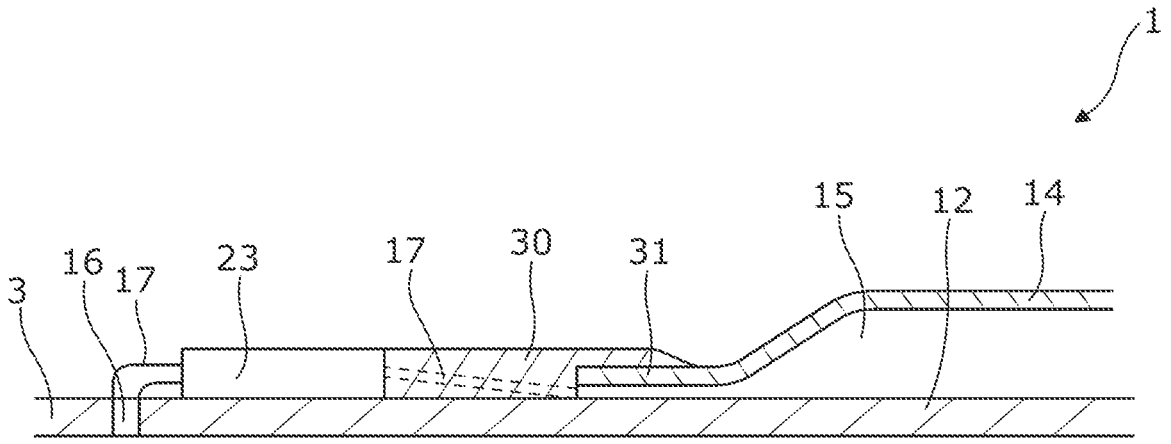
Figure 5:
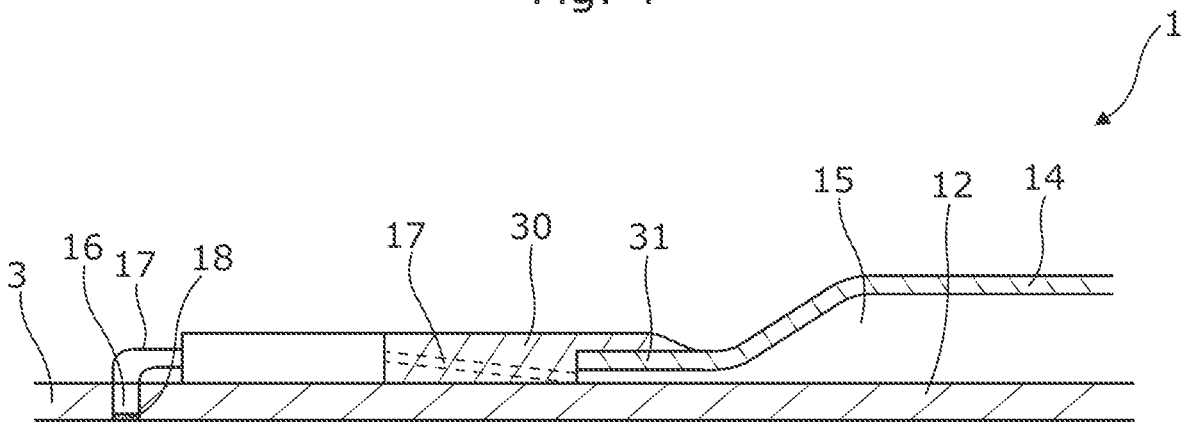
Figure 6:
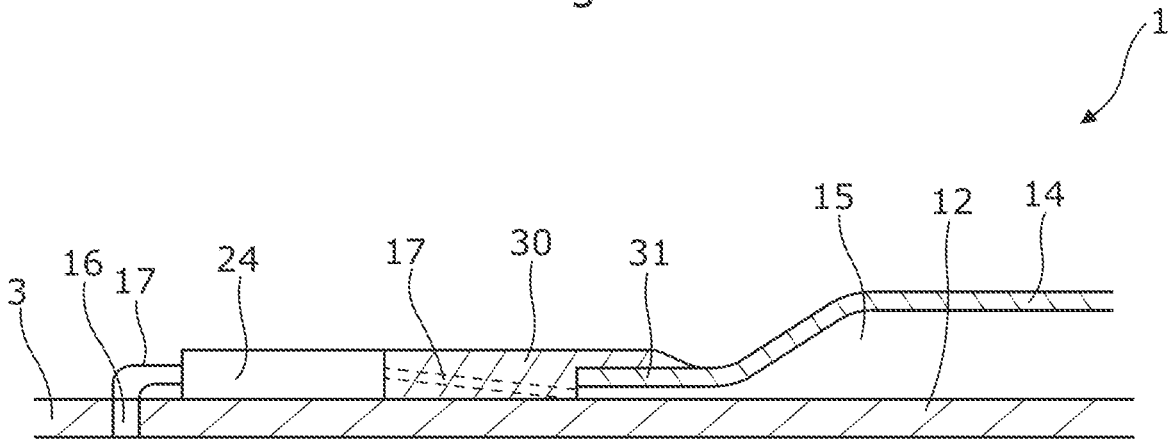
Figure 7:
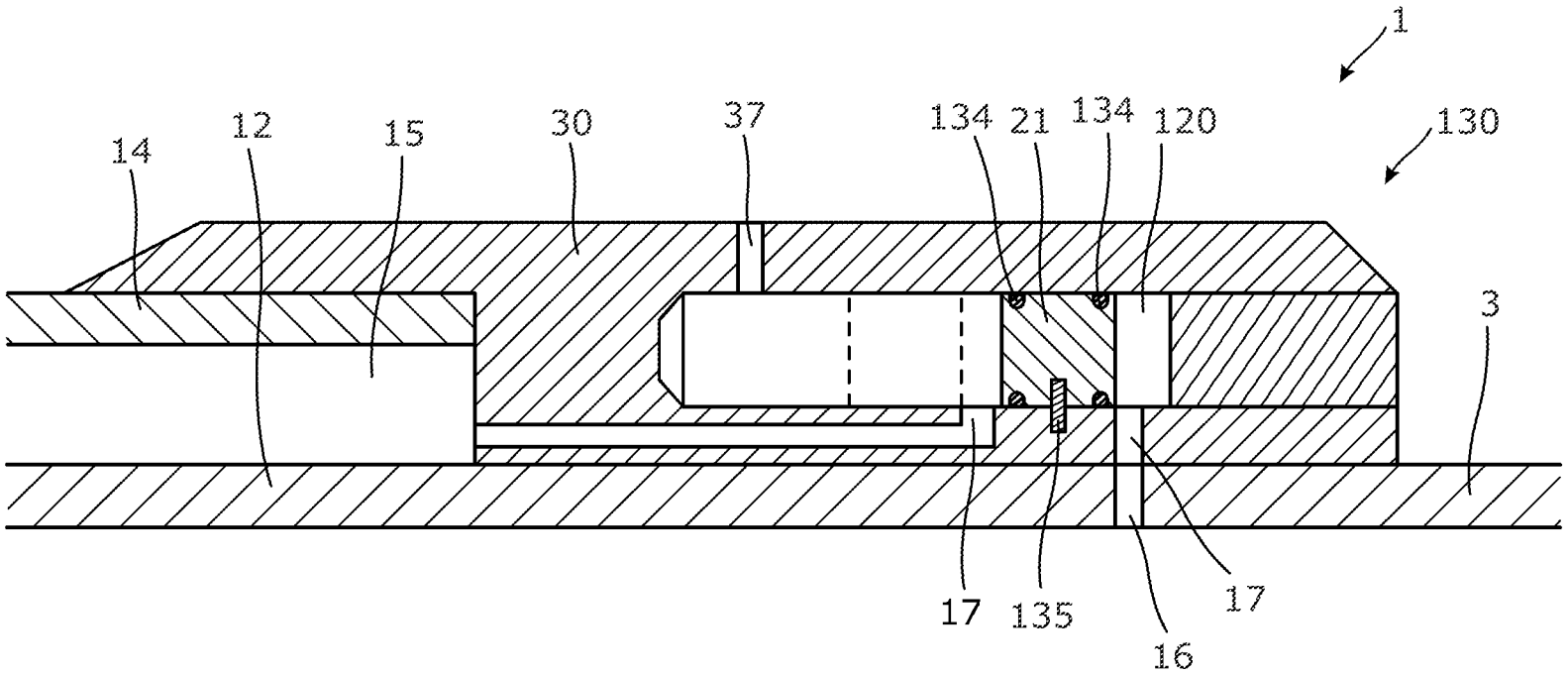
Figure 8:
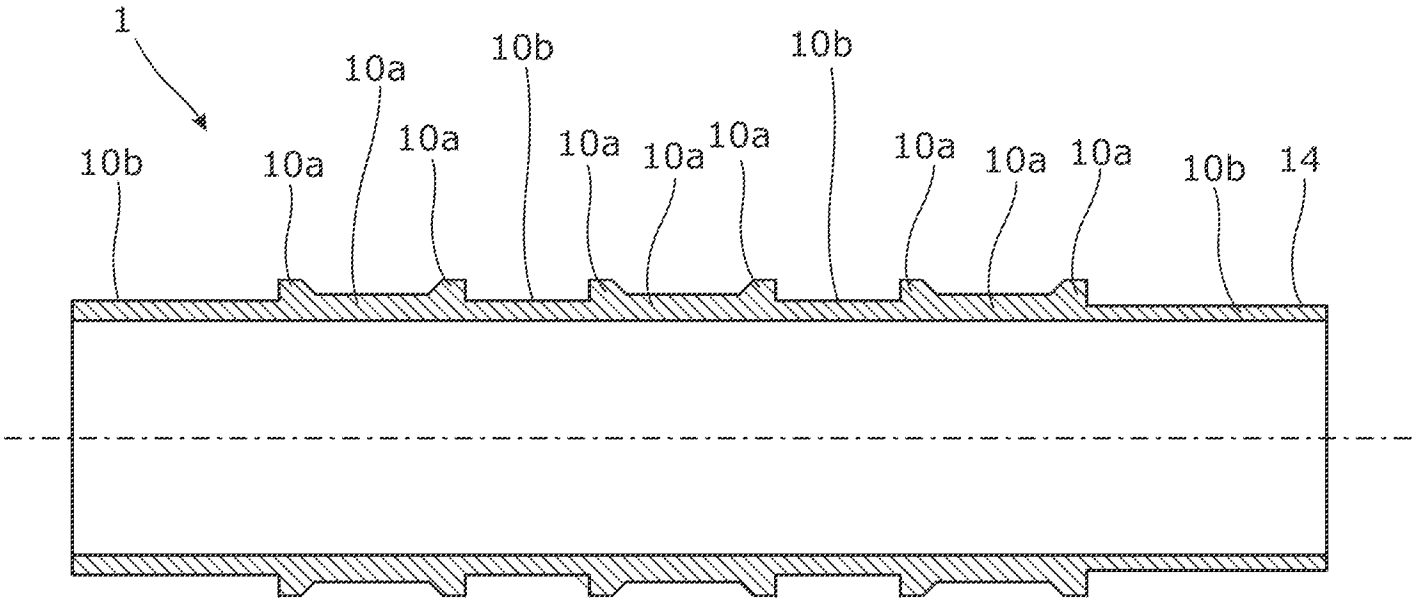
Figure 9:
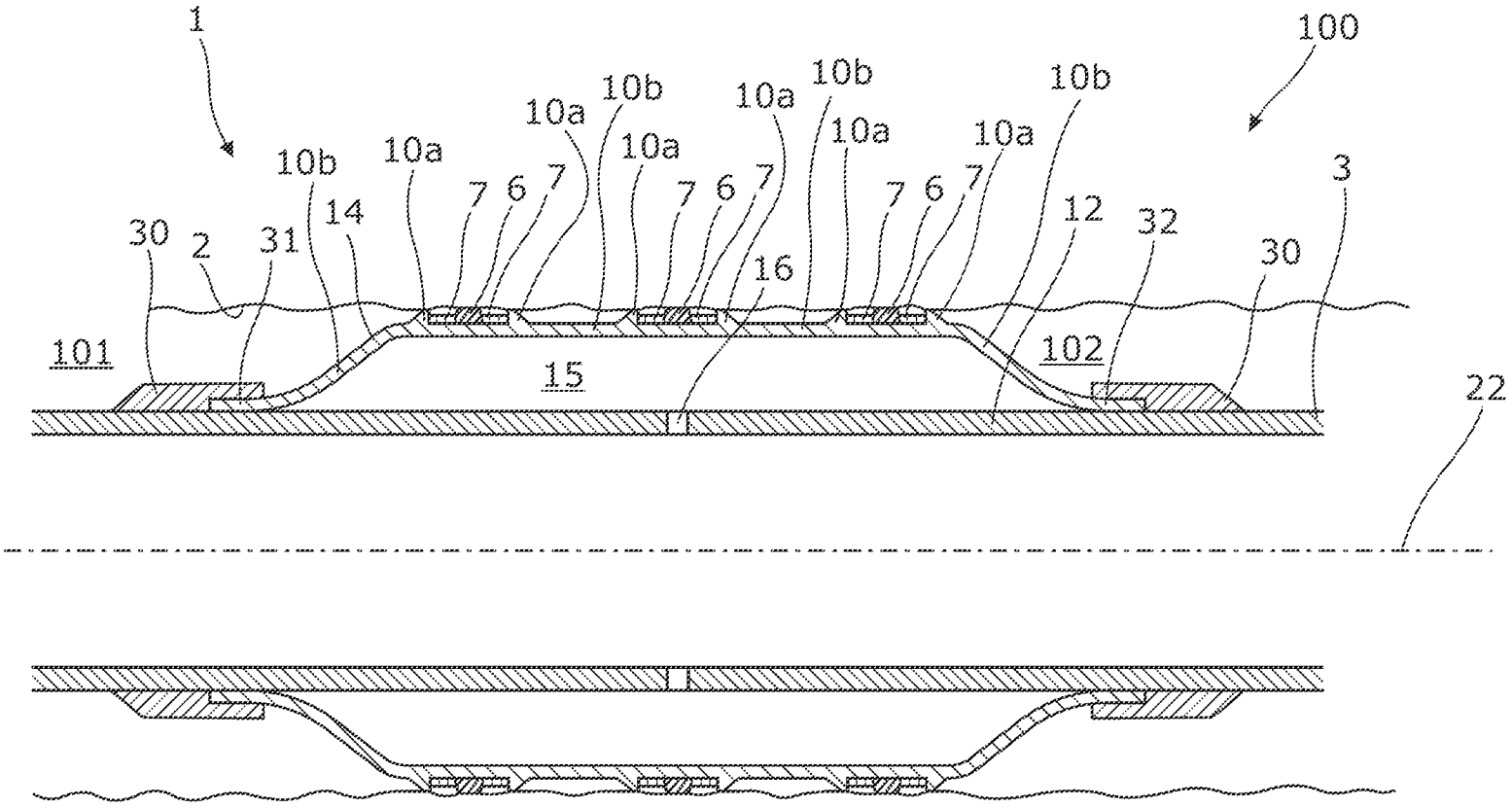

The invention and its many advantages will be described in more detail below with reference to the accompanying schematic drawings, which for the purpose of illustration show some non-limiting embodiments and in which:

FIG. 1A shows a cross-sectional view of a downhole completion system having three unexpanded annular barriers, FIG. 1B shows a cross-sectional view of a downhole completion system of FIG. 1A in which the middle annular barrier has been expanded, and the outermost annular barriers remain unexpanded, FIG. 1C shows a cross-sectional view of a downhole completion system of FIG. 1A in which all three annular barriers have been expanded, FIG. 2 shows a partly cross-sectional view of part of the second annular barrier and the third annular barrier, FIG. 3 shows a partly cross-sectional view of an annular barrier, FIG. 4 shows a partly cross-sectional view of part of another annular barrier, FIG. 5 shows a partly cross-sectional view of part of yet another annular barrier, FIG. 6 shows a partly cross-sectional view of part of yet another annular barrier, FIG. 7 shows a cross-sectional view of part of a shear pin valve of part of yet another annular barrier in a first closed position, FIG. 8 shows a cross-sectional view of an expandable metal sleeve of part of yet another annular barrier, and FIG. 9 shows a cross-sectional view of yet another annular barrier with sections having an increased thickness compared to other sections of the expandable metal sleeve.

All the figures are highly schematic and not necessarily to scale, and they show only those parts which are necessary in order to elucidate the invention, other parts being omitted or merely suggested.

FIG. 1A shows a downhole completion system 100 having three unexpanded annular barriers 1 mounted as part of a well tubular metal structure 3 arranged in a borehole 5 in a well 2. In FIG. 1B, the middle second annular barrier 1, 1*b* has been expanded before the outermost first and third annular barriers 1, 1*a*, 1*c*. An expandable metal sleeve 14 of the second annular barrier has been expanded to abut an inner face 4 of the borehole, and in this way, it is ensured that the middle annular barrier is expanded.

When expanding three or more annular barriers 1 simultaneously against an inner face of an impermeable part of the borehole formation or against another well tubular metal structure, there is a risk that the middle annular barrier cannot be fully expanded. If the well tubular metal structure comprises three annular barriers, and there is a risk that the second middle annular barrier between the first annular barrier and the third annular barrier will be unable to fully expand if the expandable metal sleeve of the first and third annular barriers abut the inner face first, the first and third annular barriers will enclose a volume of liquid, and the expandable metal sleeve of the second middle annular barrier then cannot fully expand since the liquid in the volume cannot be displaced through the impermeable formation or the other well tubular metal structure.

In FIGS. 1A-C, the downhole completion system 100 for isolating several zones 101, 102, 103, 104 in a well 2 comprises the well tubular metal structure 3 and a first annular barrier 1, 1*a*, a second annular barrier 1, 1*b* and a third annular barrier 1, 1*c*. Each annular barrier comprises a tubular metal part 12 mounted as part of the first well tubular metal structure 3, an expandable metal sleeve 14 surrounding the tubular metal part 12, and each end section 31, 32 of the expandable metal sleeve 14 being connected with the tubular metal part 12. Each annular barrier 1 further comprises an annular barrier space 15 between the tubular metal part 12 and the expandable metal sleeve 14, and an expansion opening 16 is provided in the tubular metal part 12, and a fluid channel 17 is fluidly connecting the expansion opening 16 and the annular barrier space 15, through which opening 16 and fluid channel 17 pressurised fluid passes for expanding the expandable metal sleeve 14 and bringing the annular barrier 1 from an unexpanded position to an expanded position. The second annular barrier 1*b* is arranged in between the first annular barrier and the third annular barrier 1*a*, 1*c*, and the second annular barrier 1*b* is configured to expand at a lower pressure than the first and third annular barriers 1*a*, 1*c*, so that the second annular barrier 1*b* is expanded before the first and third annular barriers 1*a*, 1*c*, as shown in FIG. 1B. In FIG. 1C, the first and third annular barriers 1*a*, 1*c* have also been expanded. Thus, the expandable metal sleeve 14 of the second annular barrier 1*b* expands at a lower pressure or at a lower flow rate in the well tubular metal structure 3 than the expandable metal sleeve 14 of the first and third annular barriers 1*a*, 1*c*.

Thus in FIGS. 1A-1C, the second annular barrier expands at a first pressure, the first annular barrier expands at a second pressure, and the third annular barrier expands at a third pressure or the second pressure, where the first pressure is lower than the second and third pressure. The second pressure is substantially the same as or equal to the third pressure.

In FIG. 2, the second annular barrier 1*b* is configured to expand at a lower pressure than the first and third annular barriers 1*a*, 1*c* in that the unexpanded expandable metal sleeve 14 of the second annular barrier 1*b* has a first thickness $t_1$ being smaller than a second thickness $t_2$ of the expandable metal sleeve 14 of the third annular barrier 1*c*. Even though not shown, the first annular barrier 1*a* may have the same thickness as the third annular barrier 1*c*. In the event that the downhole completion system 100 comprises more than three annular barriers, the outermost annular barriers may have a higher thickness than that of the first and third annular barriers 1*a*, 1*c* in order to ensure that the first and third annular barriers 1*a*, 1*c* expand and that their expandable metal sleeves 14 abut the inner face 4 before the expandable metal sleeves 14 of the outermost annular barriers.

In another aspect, the second annular barrier 1*b* is configured to expand at a lower pressure than the first and third annular barriers 1*a*, 1*c* in that the expandable metal sleeve 14 of the second annular barrier 1*b* is made of a metal material being more ductile than that of the metal material of the expandable metal sleeve 14 of the first and third annular barriers 1*a*, 1*c*.

In another aspect, the second annular barrier 1*b* is configured to expand at a lower pressure than the first and third annular barriers 1*a*, 1*c* in that the expandable metal sleeve 14 of the second annular barrier 1*b* is more flexible than the expandable metal sleeve 14 of the first and third annular barriers 1*a*, 1*c*.

Thus, the expandable metal sleeve 14 of the second annular barrier 1*b* may be made of a metal material being more flexible than that of the metal material of the expandable metal sleeve 14 of the first and third annular barriers 1*a*, 1*c* so that the second annular barrier is configured to expand at a lower pressure than the first and third annular barriers.

In the downhole completion system 100, the second annular barrier 1*b* thus comprises means for expanding the second annular barrier 1*b* before the first and third annular barriers 1*a*, 1*c*. The means may be one of several means where one is that the expandable metal sleeve 14 of the second annular barrier 1*b* has a first thickness $t_1$ being smaller than a second thickness $t_2$ of the expandable metal sleeve 14 of the first and third annular barriers 1*a*, 1*c*. Another means may be that the expandable metal sleeve 14 of the second annular barrier 1*b* is made of a metal material being more ductile than the metal material of the expandable metal sleeve 14 of the first and third annular barriers 1*a*, 1*c*. Yet another means may be that the expandable metal sleeve 14 of the second annular barrier 1*b* is made of a metal material being more flexible than the metal material of the expandable metal sleeve 14 of the first and third annular barriers 1*a*, 1*c*.

As shown in FIG. 3, in order for the second annular barrier 1*b* to expand at a lower pressure than the first and third annular barriers 1*a*, 1*c*, the second annular barrier 1*b* comprises a pressure intensifier 20 configured to increase the pressure entering the expansion opening 16 before entering the annular barrier space 15. The first and third annular barriers 1*a*, 1*c* have no pressure intensifier 20 or a pressure intensifier which increases the pressure less than the pressure intensifier 20 of the second annular barrier 1*b*. Thus, the first and third annular barriers 1*a*, 1*c* may comprise a first pressure intensifier 20 configured to increase the pressure entering the expansion opening 16 before entering the annular barrier space 15, and the second annular barrier 1*b* may comprise a second pressure intensifier 20 configured to increase the pressure entering the expansion opening 16 of the second annular barrier 1*b* before entering the annular barrier space 15 of the second annular barrier 1*b* by 10-20 bars more than the first pressure intensifier 20.

The annular barrier of FIG. 3 comprises the expandable metal sleeve 14 surrounding the tubular metal part 12, and each end 31, 32 of the expandable metal sleeve 14 is connected to the tubular metal part 12, providing the annular barrier space 15 between the expandable metal sleeve 14 and the tubular metal part 12. The annular barrier further comprises the pressure intensifier 20 through which fluid having entered through the expansion opening 16 is pressure-intensified before entering the annular barrier space 15 to expand the expandable metal sleeve 14 at a higher pressure than the pressure of the fluid entering the expansion opening 16 in the tubular metal part 12.

In FIG. 4, the first and third annular barriers 1*a*, 1*c* comprise a pressure relief valve 23 in the fluid channel 17 in order for the second annular barrier 1*b* to expand at a lower pressure than the first and third annular barriers 1*a*, 1*c*. The pressurised fluid enters the expansion opening 16, continues in the fluid channel 17 and into the pressure relief valve 23 before continuing in the fluid channel 17 through the connection part 30 and then entering the annular barrier space 15 underneath the expandable metal sleeve 14 to expand the expandable metal sleeve 14.

In order for the second annular barrier 1*b* to expand at a lower pressure than the first and third annular barriers 1*a*, 1*c*, the first and third annular barriers 1*a*, 1*c* may be provided with a shear disc 18 in the fluid channel 17 between the expansion opening 16 and the annular barrier space 15, as shown in FIG. 5. The second annular barrier 1*b* is fully expanded at a predetermined pressure, and the shear disc 18 of the first and third annular barriers 1*a*, 1*c* is sheared at a differential pressure matching the predetermined pressure so that the second annular barrier 1*b* is fully expanded before the first and third annular barriers 1*a*, 1*c* initiate expansion. The first and third annular barriers 1*a*, 1*c* are provided with a shear disc 18 in the fluid channel 17 between the expansion opening 16 and the annular barrier space 15, and the second annular barrier 1*b* has no shear disc in the fluid channel 17 between the expansion opening 16 and the annular barrier space 15. The second annular barrier 1*b* may also have a shear disc in the fluid channel 17, but this shear disc 18 is sheared at a lower pressure than that of the shear disc 18 in the first and third annular barriers 1*a*, 1*c*.

Instead of a shear disc, the first and third annular barriers 1*a*, 1*c* may be provided with a dissolvable disc (not shown) in the fluid channel 17 between the expansion opening 16 and the annular barrier space 15. The first and third annular barriers 1*a*, 1*c* are provided with the dissolvable disc (not shown) in the fluid channel 17 between the expansion opening 16 and the annular barrier space 15, and the second annular barrier 1*b* has no dissolvable disc in the fluid channel 17 between the expansion opening 16 and the annular barrier space 15. The dissolvable disc is designed so that the second annular barrier 1*b* is fully expanded before it is dissolved and the first and third annular barriers initiate expansion.

In another aspect, the first and third annular barriers 1*a*, 1*c* comprise a sequence valve 24, as shown in FIG. 6, which is activated to open for fluid communication to the annular barrier spaces 15 of the first and third annular barriers 1*a*, 1*c* at a predetermined pressure in the annular barrier space 15 of the second annular barrier 1*b*. Each sequence valve 24 of the first and third annular barriers 1*a*, 1*c* may thus be fluidly connected by means of a flow tube to the annular barrier space 15 of the second annular barrier 1*b* in order to activate the sequence valves 24 and open for expansion of the first and third annular barriers 1*a*, 1*c*.

FIG. 8 shows the expandable metal sleeve 14 of the first and third annular barriers 1*a*, 1*c* and has several sections 10*a* having a greater thickness than other sections 10*b* of the expandable metal sleeve 14 of the first and third annular barriers 1*a*, 1*c*. The expandable metal sleeve 14 of the second annular barrier 1*b* may have no sections having a greater thickness than other sections 10*b* of the expandable metal sleeve 14, or the expandable metal sleeve 14 of the second annular barrier 1*b* may have fewer sections having a greater thickness than other sections of the expandable metal sleeve 14 of the second annular barrier 1*b*. The expandable metal sleeve 14 of FIG. 8 has several sections 10*a* having a greater thickness than other sections 10*b*, and the sections 10*a* having the greater thickness also have an uneven thickness.

In FIG. 9, an annular barrier 1 mounted as part of the well tubular metal structure 3 with a longitudinal axis 22 is shown in a cross-sectional view where the expandable metal sleeve 14 of the annular barrier has an uneven thickness as the expandable metal sleeve 14 has several sections 10*a* having a greater thickness than other sections 10*b* of the expandable metal sleeve 14. At the sections 10*a* having a greater thickness than other sections, the expandable metal sleeve 14 has projections in between split ring-shaped retaining elements 7, each having three windings extending around the expandable metal sleeve 14, and the sealing element 6 also extending around the expandable metal sleeve 14.

In yet another aspect, the first and third annular barriers is, 1*c* are provided with a shear pin valve 130, as shown in FIG. 7, having a piston 21 in a bore 120 maintained in a first position by a shear pin 135 which breaks at a predetermined pressure, shifting the piston 21 to a second position in which fluid is allowed to flow from the expansion opening 16 via the fluid channel 17 to the annular barrier space 15. The piston 21 has seals 134 in order to seal to the inner face 4 of the bore 120. When a predetermined pressure is reached, being above the second pressure required to expand the second annular barrier 1*b*, the shear pin 135 breaks and the piston 21 of the shear pin valve 130 changes position so that the fluid can enter the annular barrier space 15 and expand the expandable metal sleeve 14. The shear pin valve has a venting port 37.

In order for the second annular barrier 1*b* to expand at a lower pressure than the first and third annular barriers 1*a*, 1*c*, the first and third annular barriers 1*a*, 1*c* may in another aspect each comprise a throttle valve in the fluid channel 17. The first and third annular barriers 1*a*, 1*c* each comprise a throttle valve in the fluid channel 17, and the second annular barrier 1*b* has no throttle valve in the fluid channel 17. In this way, the second annular barrier 1*b* is expanded before the first and third annular barriers 1*a*, 1*c*.

In yet another aspect, the first and third annular barriers 1*a*, 1*c* each comprise an activation unit for bringing a valve from a closed position to an open position when the pressure in the annular barrier space 15 of the second annular barrier 1*b* is above a predetermined pressure. The activation unit may be activated by a pressure increase in the annular barrier space 15 of the second annular barrier 1*b*. This may be measured by a sensor communicating with the activation unit through an electric wire or wirelessly.

Even though not shown, each end section 31, 32 of the expandable metal sleeve 14 of the second annular barrier 1*b* may be connected to the tubular metal part 12 by means of a connection part 30, where each connection part is slidably connected to the tubular metal part 12 so that the expandable metal sleeve 14 of the second annular barrier 1*b* is more easily expanded radially outwards than the expandable metal sleeve 14 of the first and third annular barriers 1*a*, 1*c* having expandable metal sleeves 14 that are fixedly fastened to the tubular metal part 12, either by welding, bite fitting or a crimped connection.

In order for the second annular barrier 1*b* to expand at a lower flow rate instead of at a lower pressure than the first and third annular barriers 1*a*, 1*c*, the first and third annular barriers 1*a*, 1*c* may in another aspect each comprise an orifice in the fluid channel 17. The fluid channel 17 is fluidly connected to the annular barrier space 15 upstream of the orifice so that a pressure-increase upstream of the orifice due to a high flow of fluid activates a valve which opens for fluid communication to the annular barrier space 15 when the pressure increase is above a certain level. The inner diameter of the fluid channel 17 of the second annular barrier 1*b* is larger than the inner diameter of the orifice of the first and third annular barriers 1*a*, 1*c*. When the inner diameter of the fluid channel 17 of the second annular barrier 1*b* is larger than the inner diameter of the orifice, the second annular barrier 1*b* is expanded at a lower flow rate than the first and third annular barriers 1*a*, 1*c*. In this way, the second annular barrier 1*b* can be expanded at one flow rate before the flow rate is increased, and the first and third annular barriers 1*a*, 1*c* are then expanded. In order to be able to vary the flow rate of the pressurised fluid, the well tubular metal structure 3 is connected with the drill pipe or coiled tubing closer to the top of the well than the first annular barrier 1*a* so that the flow rate can be changed, e.g., from one barrel per minute for expanding the second annular barrier 1*b* to two barrels per minute for expanding the first and third annular barriers 1*a*, 1*c*. The well tubular metal structure 3 has a first end closest to the top of the well and a second end. The downhole completion system further comprises a drill pipe or coiled tubing connected at a first end with the well tubular metal structure 3 at the first end of the well tubular metal structure 3.

The downhole completion method for completing a downhole completion system 100 as described above comprises mounting tubular sections with tubular metal parts 12 of the well tubular metal structure 3 having the first, second and third annular barriers 1*a*, 1*b*, 1*c*, and the second annular barrier 1*b* being mounted to be arranged in between the first annular barrier and the third annular barrier 1*a*, 1*c*. The downhole completion method further comprises lowering the well tubular metal structure 3 in the well until the well tubular metal structure 3 is arranged in a predetermined position, and pressurising the well tubular metal structure 3 to a first pressure and expanding the second annular barrier 1*b*. During the pressurising of the well tubular metal structure 3 from within to a first pressure and expansion of the second annular barrier 1*b*, the first and third annular barriers 1*a*, 1*c* remain unexpanded. The expansion of the first and third annular barriers 1*a*, 1*c* is initiated after the expansion of the second annular barrier 1*b* has been initiated, and for some aspects described above, the expansion of the first and third annular barriers 1*a*, 1*c* is initiated after the expansion of the second annular barrier 1*b* has ended.

The downhole completion method further comprises increasing the pressure to a second pressure to expand also the first and/or third annular barriers 1*a*, 1*c* or increasing the flow rate to a second flow rate to expand also the first and third annular barriers 1*a*, 1*c*.

The downhole completion method further comprises increasing the pressure to a third pressure to also expand the other of the first and third annular barriers 1*a*, 1*c*.

The downhole completion method where the flow rate has to be increased in order for the second annular barrier 1*b* to expand before the first and third annular barriers 1*a*, 1*c* comprises connecting a drill pipe to a first end of the well tubular metal structure 3 before lowering the well tubular metal structure 3, and then lowering the well tubular metal structure 3 also comprises lowering the drill pipe into the borehole 5 until the well tubular metal structure 3 is arranged in a predetermined position, the pressurising of the well tubular metal structure 3 also comprising pressurising the drill pipe. Then, the pressurising of the well tubular metal structure 3 to a first pressure is performed at a predetermined first flow rate, the downhole completion method further comprising increasing the flow rate to a second flow rate to expand also the first and third annular barriers 1*a*, 1*c*.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. Downhole completion system for isolating several zones in a well having a top, comprising:

a well tubular metal structure arranged in a borehole having an inner face configured to be positioned in the well, and a first annular barrier, a second annular barrier and a third annular barrier, each annular barrier comprising:

a tubular metal part, the tubular metal part being mounted as part of the well tubular metal structure, an expandable metal sleeve surrounding the tubular metal part, each end section of the expandable metal sleeve being connected with the tubular metal part, an annular barrier space between the tubular metal part and the expandable metal sleeve, and an expansion opening in the tubular metal part and a fluid channel fluidly connecting the expansion opening and the annular barrier space through which pressurised fluid passes for expanding the expandable metal sleeve and bringing the annular barrier from an unexpanded position to an expanded position, wherein the second annular barrier is arranged in between the first annular barrier and the third annular barrier, and the second annular barrier expands at a first pressure, the first annular barrier expands at a second pressure, the third annular barrier expands at a third pressure, the first pressure is lower than at least one of the second pressure and the third pressure.

2. Downhole completion system according to claim 1, wherein the expandable metal sleeve of the second annular barrier expands at a lower pressure than the expandable metal sleeve of the first and third annular barriers.

3. Downhole completion system according to claim 1, wherein the expandable metal sleeve of the second annular barrier has a first thickness being smaller than a second thickness of the expandable metal sleeve of the first and third annular barriers.

4. Downhole completion system according to claim 1, wherein the expandable metal sleeve of the second annular barrier is made of a metal material being more ductile than the metal material of the expandable metal sleeve of the first and third annular barriers.

5. Downhole completion system according to claim 1, wherein the expandable metal sleeve of the second annular barrier is more flexible than the expandable metal sleeve of the first and third annular barriers.

6. Downhole completion system according to claim 1, wherein the expandable metal sleeve of the first and third annular barriers has several sections having a greater thickness than other sections of the expandable metal sleeve of the first and third annular barriers, and the expandable metal sleeve of the second annular barrier has fewer sections having a greater thickness than other sections of the expandable metal sleeve of the second annular barrier.

7. Downhole completion system according to claim 1, wherein the first and third annular barriers are provided with a shear disc in the fluid channel between the expansion opening and the annular barrier space.

8. Downhole completion system according to claim 1, wherein the second annular barrier comprises a pressure intensifier configured to increase the pressure entering the expansion opening before entering the annular barrier space.

9. Downhole completion system according to claim 1, wherein the first and third annular barriers comprise a pressure relief valve in the fluid channel.

10. Downhole completion system according to claim 1, wherein the first and third annular barriers comprise a sequence valve which is activated to open for fluid communication to the annular barrier spaces of the first and third annular barriers at a predetermined pressure in the annular barrier space of the second annular barrier.

11. Downhole completion system according to claim 1, wherein the first and third annular barriers each comprise a throttle valve in the fluid channel.

12. Downhole completion system according to claim 1, wherein the well tubular metal structure has a first end closest to the top and a second end, the downhole completion system further comprising a drill pipe or coiled tubing connected at a first end with the well tubular metal structure at the first end of the well tubular metal structure.

13. Downhole completion method for completing a downhole completion system according to claim 1, comprising:

mounting tubular sections with tubular metal parts of the well tubular metal structure having the first, second and third annular barriers, the second annular barrier being mounted to be arranged in between the first annular barrier and the third annular barrier, lowering the well tubular metal structure in the well until the well tubular metal structure is arranged in a predetermined position, and pressurising the well tubular metal structure to a first pressure and expanding the second annular barrier.

14. Downhole completion method according to claim 13, further comprising increasing the pressure to a second pressure to expand also the first and third annular barriers.

15. Downhole completion method according to claim 13, wherein the pressurising of the well tubular metal structure to a first pressure is performed at a predetermined first flow rate, the downhole completion method further comprising increasing the flow rate to a second flow rate to expand also the first and third annular barriers.

16. Downhole completion system according to claim 1, wherein the first pressure is lower than the second pressure and the third pressure.

17. Downhole completion system according to claim 1, wherein the first pressure is lower than only one of the second pressure or the third pressure.

18. Downhole completion system according to claim 17, wherein the first pressure is lower than the second pressure.

19. Downhole completion system according to claim 17, wherein the first pressure is lower than the third pressure.

* * * * *